United States Patent [19]

Suzuki et al.

[11] Patent Number: 4,479,476

[45] Date of Patent: Oct. 30, 1984

[54] METHOD AND APPARATUS FOR OPTIMUM CONTROL OF INTERNAL COMBUSTION ENGINES

[75] Inventors: Atsushi Suzuki; Masakazu Ninomiya, both of Kariya, Japan

[73] Assignee: Nippondenso Co., Ltd., Kariya, Japan

[21] Appl. No.: 341,171

[22] Filed: Jan. 20, 1982

[30] Foreign Application Priority Data

Jan. 26, 1981 [JP] Japan ..... 56-9835

[51] Int. Cl.[3] ..... F02M 51/00

[52] U.S. Cl. ..... 123/478; 123/436; 123/588

[58] Field of Search ..... 123/339, 419, 436, 478, 123/480, 588

[56] References Cited

U.S. PATENT DOCUMENTS

| | | | |
|---|---|---|---|
| 3,596,643 | 8/1971 | Schweitzer | 123/419 |
| 4,026,251 | 5/1977 | Schweitzer et al. | 123/436 |
| 4,106,451 | 8/1978 | Hattori et al. | 123/588 |
| 4,181,944 | 1/1980 | Yamauchi et al. | 123/480 |
| 4,319,451 | 3/1982 | Tajima et al. | 123/480 |
| 4,322,800 | 3/1982 | Hisegawa et al. | 123/419 |
| 4,354,238 | 10/1982 | Manaka et al. | 123/480 |

FOREIGN PATENT DOCUMENTS

| | | |
|---|---|---|
| 49428 | 4/1979 | Japan . |
| 60639 | 5/1980 | Japan . |

*Primary Examiner*—Parshotam S. Lall
*Assistant Examiner*—W. R. Wolfe
*Attorney, Agent, or Firm*—Cushman, Darby & Cushman

[57] ABSTRACT

In a method and an apparatus for optimum control of an internal combustion engine, an air-fuel ratio is dithered by a dither amount from a basic air-fuel ratio and the engine is operated with the dithered air-fuel ratio. A resultant change of the output state of the engine is detected, and the direction of improving fuel consumption is decided by the change of the output state of the engine so that the basic air-fuel ratio is changed in that direction. Either the dither period during which the engine is operated with different selected air-fuel ratios or the dither amount is determined with elevated precision by a signal detected in association with the output state of the engine.

11 Claims, 14 Drawing Figures

FIG. 7

ENGINE SPEED →

| Ne / Pm | --- | --- | r-2 | r-1 | r | r+1 | r+2 | --- | --- |
|---|---|---|---|---|---|---|---|---|---|
| --- | | | | | | | | | |
| --- | | | | | | | | | |
| p-1 | | | ΔT(p-1,r-2) | ΔT(p-1,r-1) | ΔT(p-1, r) | ΔT(p-1,r+1) | ΔT(p-1,r+2) | | |
| p | | | ΔT(p ,r-2) | ΔT(p,r-1) | ΔT( p , r) | ΔT (p ,r+1) | ΔT(p,r+2) | | |
| p+1 | | | ΔT(p+1,r-2) | ΔT(p+1,r-1) | ΔT (p+1, r) | ΔT(p+1,r+1) | ΔT(p+1,r+2) | | |
| --- | | | | | | | | | |
| --- | | | | | | | | | |

INTAKE PRESSURE →

METHOD AND APPARATUS FOR OPTIMUM CONTROL OF INTERNAL COMBUSTION ENGINES

BACKGROUND OF THE INVENTION

1. Field of the Invention

The present invention relates to a method and an apparatus for controlling an internal combustion engine in which an air-fuel ratio of an air-fuel mixture is feedback controlled with elevated precision and high response speed to have an air-fuel ratio value which provides the best fuel cosumption.

2. Description of the Prior Art

An apparatus for optimum control of internal combustion engines is known in which the amount of intake air, which is a controlled variable of the internal combustion engine, is changed by a predetermined amount and the resultant change of the operating condition of the internal combustion engine is used to determine the direction of improvement of fuel consumption and the air-fuel ratio is modified in such a direction. The prior art apparatuses of this type are disclosed in the Laid-Open Japanese Patent Application Nos. 60639/80 and 49428/79 and U.S. Pat. No. 4026251.

In the conventional apparatuses, however, the period during which an internal combustion engine is operated with a controlled variable changed by a predetermined amount is not always an optimum period for the operating conditions of the engine, with the result that the accuracy of determining the direction of improvement of fuel consumption is not necessarily reliable. Therefore, it is difficult to feedback control the controlled variable of the internal combustion engine toward a controlled variable value for the best fuel consumption, which causes a loss of fuel consumption.

The present invention has been made to solve the above-mentioned problem.

SUMMARY OF THE INVENTION

An object of the present invention is to propose a method and an apparatus for optimum control of internal combustion engines in which, either the period of operating an internal combustion engine with a changed air-fuel ratio or the magnitude of the airfuel ratio to be changed is determined by a signal associated with the then operating condition of the internal combustion engine, and the engine is made to operate with such a periof or magnitude of the changed air-fuel ratio, and the resultant change of the operating condition of the engine is detected, whereby the direction of the change of the air-fuel ratio to improve fuel consumption is determined, and thus the air-fuel ratio is feedback controlled to provide the best fuel consumption with elevated precision and high response speed.

BRIEF DESCRIPTION OF THE DRAWINGS

FIG. 7 is a diagram showing an example of a map stored in a memory of a microcomputer in the apparatus shown in FIG. 1.

In the drawings, like reference numerals refer to like parts or items.

DESCRIPTION OF THE PREFERRED EMBODIMENTS

Embodiments of the present invention will be described below with reference to the accompanying drawings.

Figure 1:
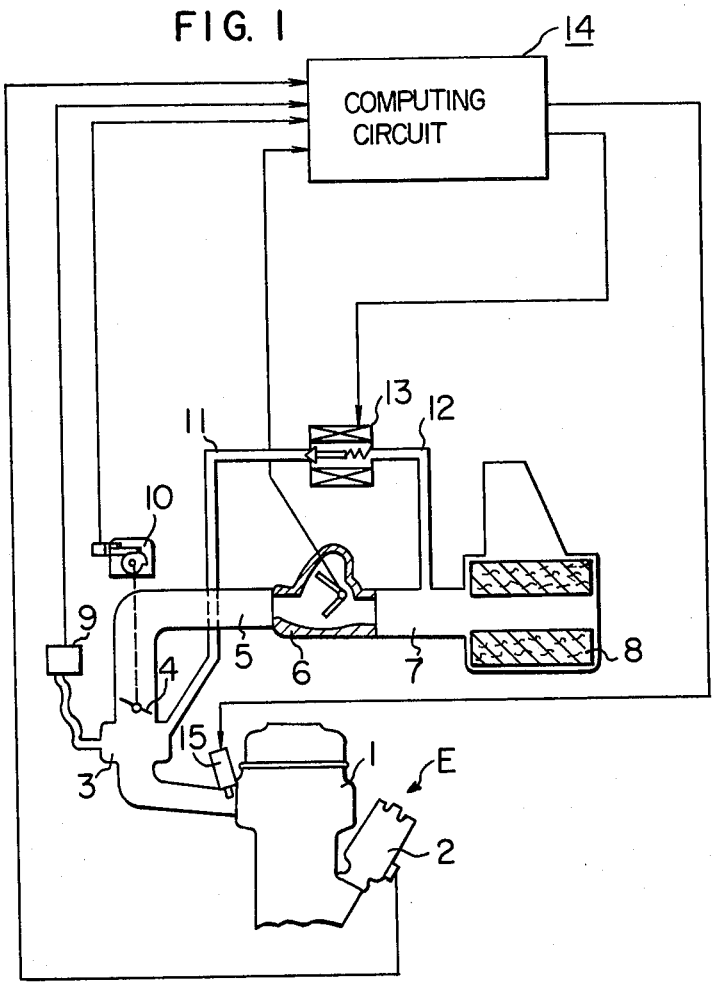
FIG. 1 is a schematic diagram showing an apparatus for controlling an air-fuel ratio of an internal combustion engine used in the method of controlling the air-fuel ratio of the engine according to an embodiment of the present invention.

FIG. 1 shows an apparatus for controlling an air-fuel ratio of an internal combustion engine E to which the method of controlling the air-fuel ratio of the engine according to the present invention has been applied. The apparatus comprises a body 1 of the internal combustion engine E, a rotational angle sensor or engine speed sensor 2 constructed integrally with a distributor, a throttle valve 4 interlinked with an accelerator, an air intake pipe 3 downstream of the throttle valve 4 and an intake air flow sensor 6. The intake air flow sensor 6 detects an air flow rate in such a way that the opening of a baffle plate disposed in an air path is changed by the air flow rate and the air flow rate is detected by the change of an output voltage in response to the opening of the baffle plate. The apparatus also comprises a downstream air intake pipe 5 connecting the intake air flow sensor 6 with a portion of the throttle valve 4, an air cleaner 8, an upstream air intake pipe 7 connecting the intake air flow sensor 6 with the air cleaner 8, a pressure sensor 9 for detecting intake pressure, a throttle sensor 10 for detecting a totally closed state of the throttle valve 4 and the opening of the throttle valve 4 which is 60% or more, an electromagnetic bypass air valve 13 disposed to bypass the intake air flow sensor 6 and the throttle valve 4, a downstream bypass air pipe 11 connecting the electromagnetic bypass air valve 13 with the intake pipe 3, an upstream bypass air pipe 12 connecting the electromagnetic air bypass valve 13 with the upstream air intake pipe 7, and a computing circuit 14. The computing circuit 14 comprises a microcomputer for handling a digital signal and responds to input signals thereto from the intake air flow sensor 6, the rotational angle sensor 2, the throttle sensor 10 and the intake pipe pressure sensor 9 and computes the quantity of fuel injection by a fuel injector 15 as a time width of a pulse, thus producing an output signal to be supplied to the fuel injector 15.

Figure 2:
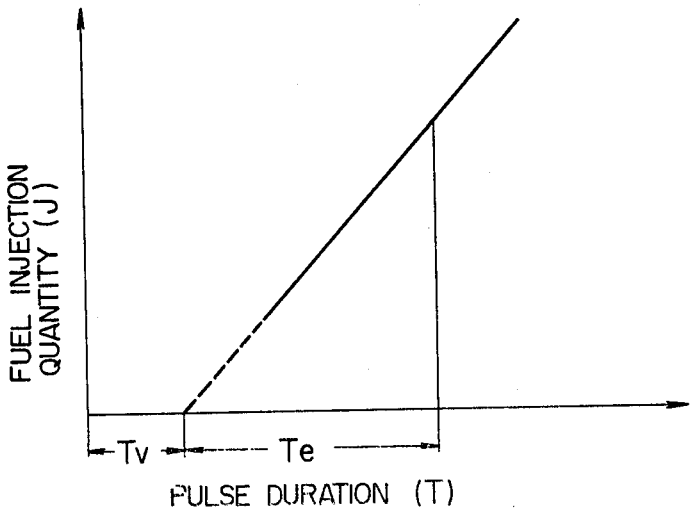
FIG. 2 is a characteristic diagram showing the relation between a valve opening pulse duration and the amount of fuel injection by an electromagnetic injection valve.

The diagram of FIG. 2 shows the relation between the pulse duration T and the fuel injection quantity J of the electromagnetic fuel injector 15 for intermittently injecting fuel maintained at a constant pressure in accordance with the pulse duration. With an increase in the output pulse duration T produced by the computing circuit 14, the fuel injection quantity J of the fuel injector 15 increases linearly. The resultant time delay in the opening and closing operations of the injection valve is expressed by $T_v$, and the effective range of the pulse duration for controlling the opening period of the injector is given by $T_e$.

Figure 3:
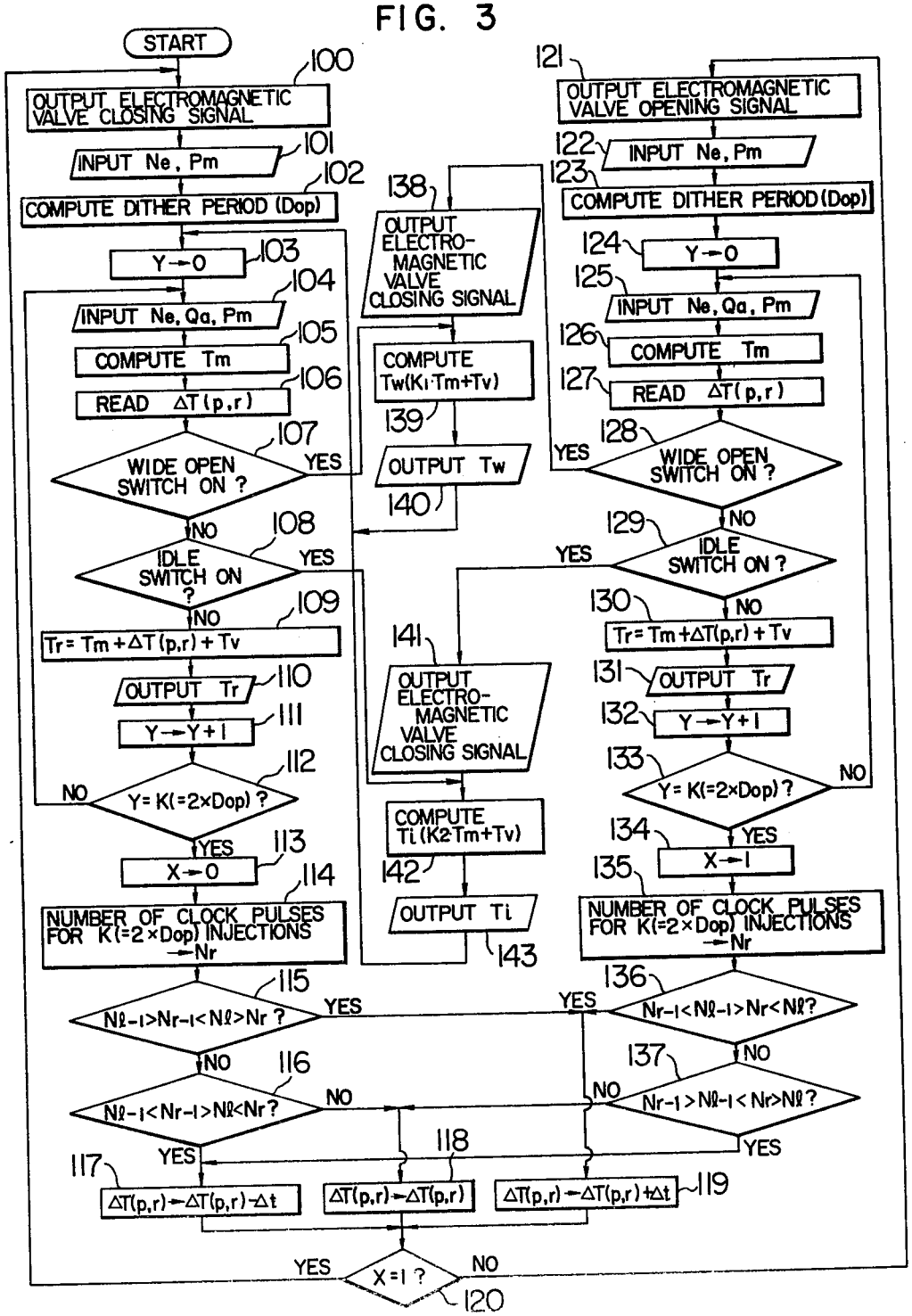
FIG. 3 is a flowchart showing the operation processes of a computing circuit of the apparatus shown in FIG. 1.

The operation processes of the computing circuit 14 are shown in the flowchart of FIG. 3.

With the start of the internal combustion engine E, the operation processes are initiated from a step 100 where the on-off electromagnetic bypass air valve 13 is closed. At a step 101, the computing circuit 14 inputs the values of the engine speed $N_e$ and the intake pressure $P_m$ detected by the rotational angle sensor 2 and the pressure sensor 9, respectively. At a step 102, computation is effected to obtain a dither period, which signifies a period during which the engine E is operated with a controlled variable of the engine (intake air flow is taken in the embodiment of this invention under consideration) changed by a predetermined amount. In the method for optimum control of the engine in this embodiment, the direction of improvement of fuel consumption is determined from a change of the operating state of the engine when the bypassing supply of an unmeasured amount of air to the downstream portion 3 of the throttle valve 4 is effected or stopped. In order to determine the direction of improvement of fuel consumption with elevated precision, it is necessary to supply a sufficient amount of air through a bypass air pipe to the downstream portion 3 of the throttle valve 4 thereby to cause a change in the operating state. Under a heavy load, however, the pressure difference between the upstream and downstream portions of the throttle valve 4 becomes small thereby limiting the quantity of air capable of being supplied through the bypass air pipe. If a small quantity of air is supplied through the bypass air pipe, the change of the operating state of the engine is small. Therefore, if the dither period is fixed irrespective of the operating state of the engine, it is not possible to cause a sufficient change of the operating state of the engine when it is under a heavy load, and it is not possible to effect feedback control with satisfactory precision to reach the best fuel consumption, thereby causing some loss of fuel consumption.

Figure 4A:
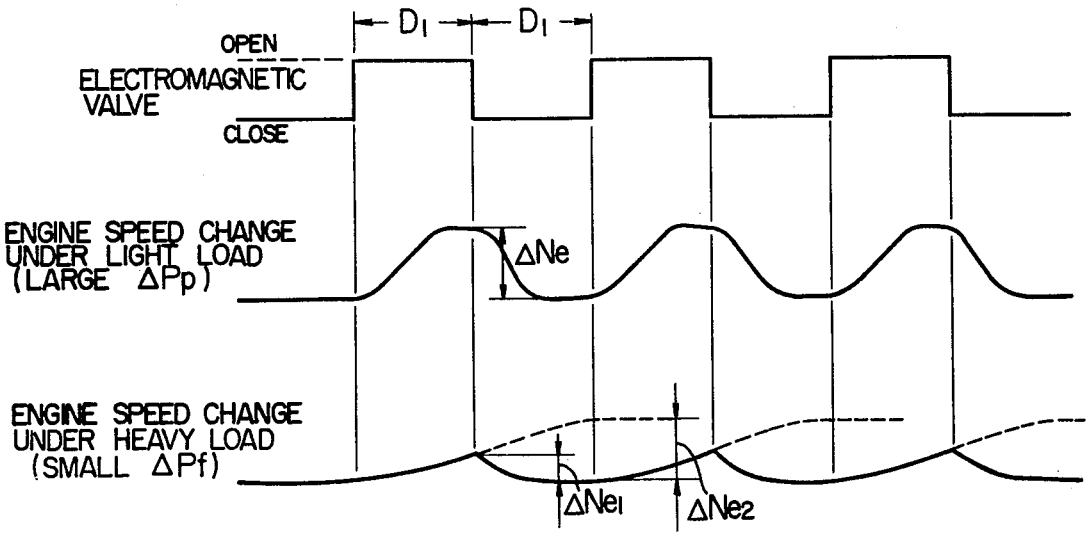
FIGS. 4*a* and 4*b* are waveform diagrams showing the relation between a dither period and a change of engine speed for each operating condition of the internal combustion engine.

The above-mentioned fact will be described with reference to FIGS. 4*a* and 4*b*.

Assume that the dither period is fixed regardless of the operating state. As shown in FIG. 4*a*, the operating condition of the engine is set to be under a light load and a heavy load at a certain engine speed, and the electromagnetic valve 13 is turned on and off with a predetermined dither period $D_1$. Now, the change of the engine speed is taken into consideration on condition that the torque is maintained constant. If the pressure difference between the upstream and downstream portions of the throttle valve 4 under a light load be denoted by $\Delta P_p$, and the air passage area, when the electromagnetic valve 13 is turned on, be denoted by A, the bypass air quantity $\Delta Q_{bp}$ is given by $C_1A\sqrt{\Delta P_p}$ ($C_1$: a constant), and the change of the engine speed caused by the bypass air quantity is given by $\Delta N_e$.

On the other hand, in the control under a heavy load, the pressure difference between the upstream and downstream portions of the throttle valve 4 becomes $\Delta Pf$ ($<\Delta P_p$), and the bypass air quantity $\Delta Q_{bf}$ capable of being supplied through the bypass air pipe when the electromagnetic valve 13 is turned on is given by $C_2A\sqrt{\Delta P_f}$ ($C_2$: a constant). This bypass air quantity is very small as compared with the quantity $Q_f$ of the main supply air flowing through the throttle valve 4 under a heavy load, so that the engine speed increases slowly along the dotted lines shown at the bottom of FIG. 4*a*. Assume that a final engine speed change to be caused by the bypass air quantity $\Delta Q_{bf}$ is $\Delta N_{e2}$ and that the electromagnetic valve 13 is controlled to be turned on and off at a dither period same as that under the light load. In this case, the electromagnetic valve 13 is turned off before the change of the engine speed reaches $\Delta N_{e2}$, so that the engine speed change remains small as shown by $\Delta N_{e1}$ in FIG. 4*a*. In this way, the change of the engine speed under a heavy load may be very small as compared with that under a light load, and hence it is impossible to determine the direction of improvement of fuel consumption under a heavy load with sufficient precision.

Figure 5:
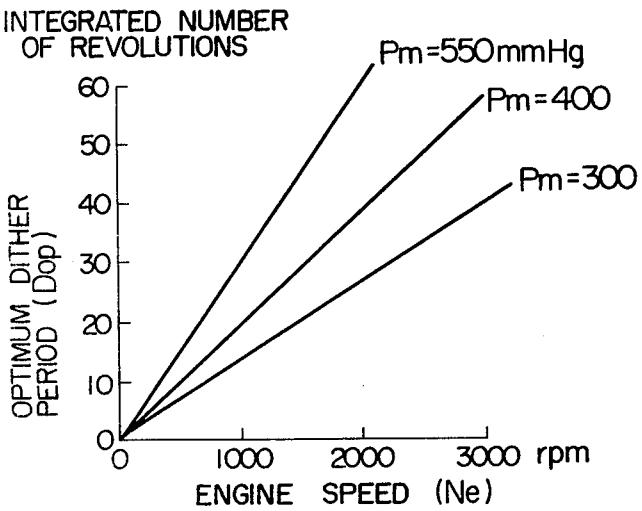
FIG. 5 is a characteristic diagram showing the relation between the operating condition of the internal combustion engine and the optimum dither period.
Figure 6:
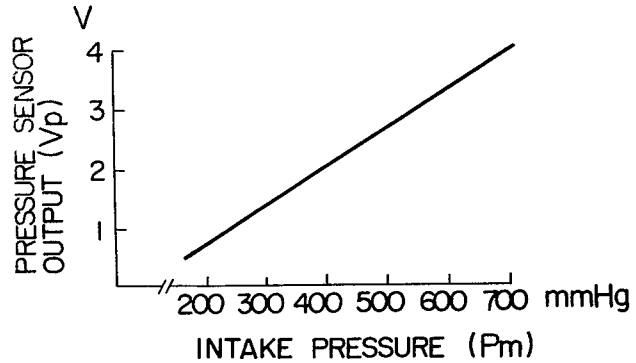
FIG. 6 is a characteristic diagram showing the output characteristic of a pressure sensor.

Then, the experiment conducted to seek an optimum dither period ($D_{op}$) (as expressed by the number of revolutions of the internal combustion engine in this embodiment), which permits precise determination of the direction of improvement of fuel consumption under all engine operating conditions, has revealed the relation as shown in FIG. 5. The characteristic of the output $V_p$ of the pressure sensor 9 is shown in FIG. 6.

Thus, the optimum dither period $D_{op}$ can be represented by $$D_{op}=K_1\times Ne\times Vp \quad (K_1\text{: a constant})$$

Figure 4B:
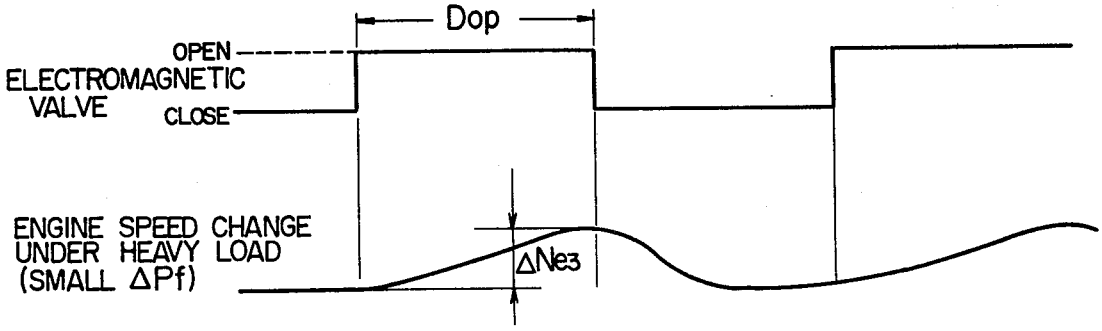

An example of the characteristic when the dither period is controlled at an optimum value under a heavy load is shown by $\Delta N_{e3}$ in FIG. 4*b*. In this case, the maximum change of the engine speed is obtained for a given opening area of the electromagnetic valve 13.

After the computation of the dither period $D_{op}$ at the step 102, the process proceeds to a step 103 where the initialization of a counter Y for counting the number of injections is effected ($Y\rightarrow 0$). In the method of the present invention, fuel injection in a four cylinder and four stroke cycle engine is effected once at every revolution at a predetermined crank angle, so that the integrated number of revolutions of the engine is obtained by counting the number of fuel injections.

At a step 104, the computing circuit 14 inputs the engine speed $N_e$, the intake air flow $Q_a$ and the intake pressure $P_m$ from the rotational angle sensor 2, the air flow sensor 6 and the pressure sensor 9, respectively. At a step 105, the computation of a main pulse duration $T_m$ aiming at a stoichiometric air-fuel ratio of about 15 is effected by using the engine speed $N_e$ and the intake air flow $Q_a$. At a step 106, the correction pulse duration $\Delta T(p, r)$ corresponding to the present engine speed $N_e$ and the present intake pressure $P_m$ detected by the pressure sensor 9 is read from a map, such as shown in FIG. 7, stored in the memory.

The memory for storing the map shown in FIG. 7 is a non-volatile memory unit comprised in the computing circuit 14 and stores the map of $\Delta T(p, r)$ with the values of the engine speed $N_e$ and the intake pressure $P_m$ therein divided at predetermined intervals.

At a step 107, the throttle sensor 10 decides whether the opening of the throttle valve 4 is 60% or more, that is, whether the wide open switch is on. When the opening is 60% or more, the step 107 branches to YES, and the process transfers to a step 139, where the main pulse duration $T_m$ computed at the step 105 is multiplied by a correction facotr $K_1$ for obtaining an power air-fuel ratio (about 13) and further to the product thus obtained is added the opening delay time $T_v$ of the fuel injector 15 in the relation between the pulse duration and fuel injection quantity shown in FIG. 2. The pulse duration $T_w$, when the opening of the throttle valve 4 is 60% or more, is given by the equation below.

$$T_w = K_1 \cdot T_m + T_v$$

At a step 140, the pulse duration $T_w$ is output to the fuel injector 15, and the process returns to the step 103. In other words, if the opening of the throttle valve 4 is 60% or more, the decision or correction of the air-fuel ratio toward the best fuel consumption is not effected.

If the opening of the throttle valve 4 is less than 60%, the step 107 branches to NO, and the process proceeds to a step 108. The step 108 decides whether the throttle valve 4 is totally closed (namely, whether the idle switch is turned on). If the throttle valve 4 is totally closed, the step 108 branches to YES, and the process proceeds to a step 142. The step 142 computes the pulse duration for the idling air-fuel ratio by multiplying the main pulse duration $T_m$ computed at the step 105 with a correction facotr $K_2$ and adding thereto the valve opening delay time $T_v$. Thus, the pulse duration $T_i$ for idling is given by the equation below.

$$T_1 = K_2 \cdot T_m + T_v$$

At a step 143, the pulse duration $T_i$ is output to the fuel injector 15, and the process returns to the step 103. In other words, during the idling operation of the engine, as in the case where the opening of the throttle valve 4 is 60% or more, the decision or correction of the air-fuel ratio toward the best fuel consumption is not effected.

If the opening of the throttle valve 4 is not in the state of idling, the step 108 branches to NO, and the process proceeds to a step 109. The step 109 computes a final pulse duration $T_r$ by adding the main pulse duration $T_m$, the correction pulse duration $\Delta T(p, r)$ and the valve opening delay time $T_v$ together. At a step 110, the final pulse duration $T_r$ is output to the fuel injector 15.

At a step 111, the injection number count Y of the injection number counter is incremented by one. A next step 112 continues to branch to NO until the count Y reaches a set number K ($=2\times D_{op}$), thus circulating in the loop from the step 104 to the step 112.

At a step 113, X is set to 0. Here, the closed state of the electromagnetic bypass air valve 13 forms a rich cycle, while, the opened state of the valve 13 forms a lean cycle. The character X is an index for incidating whether the present operation is a rich cycle or a lean cycle. When X is 0, it indicates the operation of a rich step with the electromagnetic valve 13 being closed, while when X is 1, it indicates the operation of a lean step with the electromagnetic valve 13 being opened. At a step 114, the count $N_r$ representing the number of clock pulses of a predetermined frequency generated by a clock pulse generator while a set number (K) of fuel injections are effected, which corresponds to the engine rotational period (that is the engine rotational time) during the set number (K) of fuel injections, is stored in the memory. With respect to the relation between the number of clock pulses and the engine speed, with an increase in the engine speed, the period during which K time injections is effected is shortened and therefore the count of clock pulses during the same period is reduced.

Figure 8:
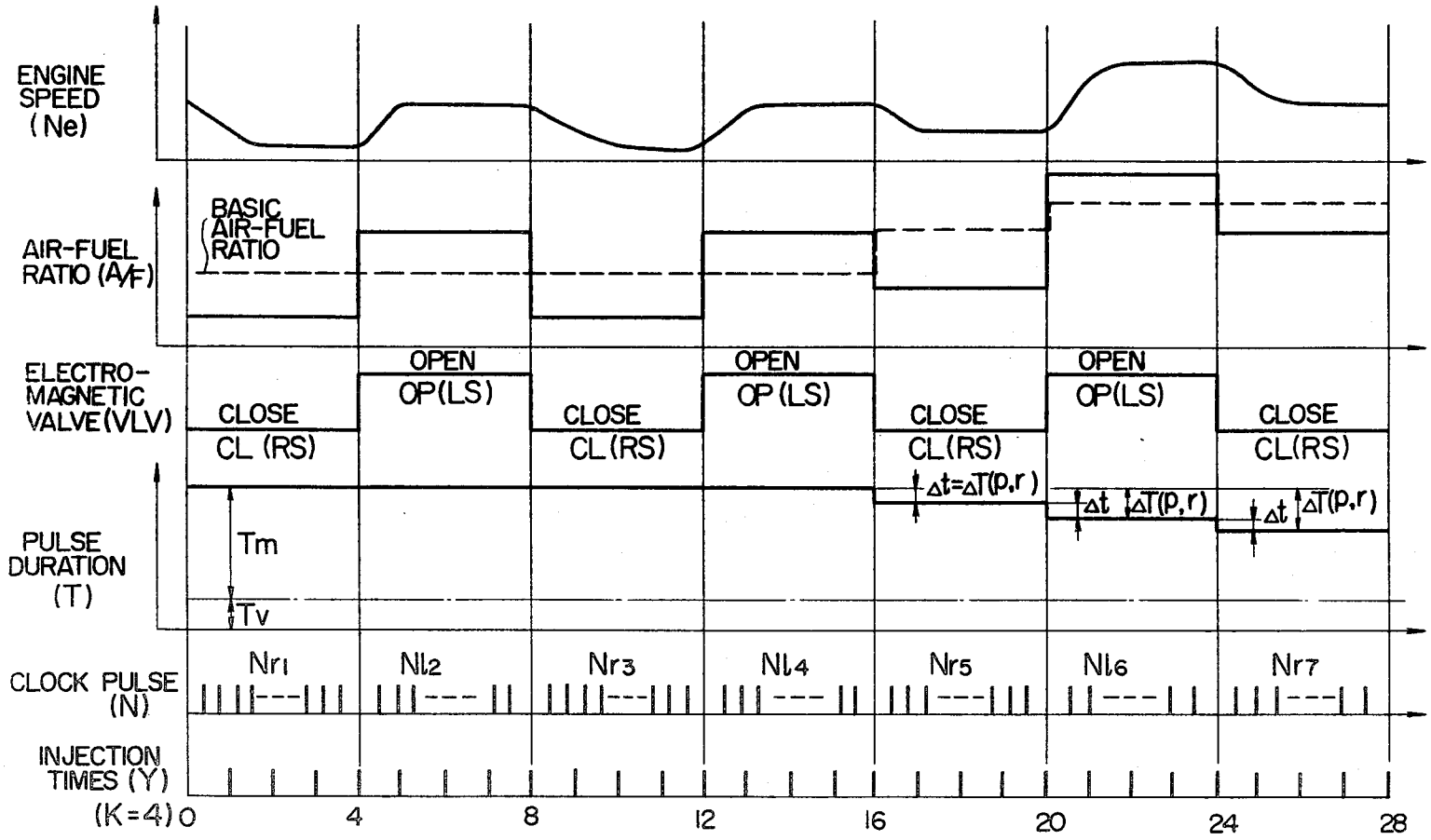
FIG. 8 is a waveform diagram illustrating the progress of the operation processes shown in the flowchart of FIG. 3.

The process of the above-described operation will be described with reference to the time chart of FIG. 8 which illustrates the progress of the computing process. In FIG. 8, there are shown electric signal waveforms representing the engine speed $N_e$, the air-fuel ratio A/F, the state VLV of the electromagnetic bypass air valve 13, the pulse duration T, the clock pulse N and the number of fuel injections Y. The dashed line in the waveform of the air-fuel ratio A/F shows a basic air-fuel ratio. As mentioned above, a rich cycle (RS) occurs when the electromagnetic bypass air valve 13 is in the closed state (CL), while, a lean cycle (LS) occurs when the valve 13 is in the opened state (OP). As seen from FIG. 8, the number of fuel injections K is set to 4, and, for example, the number of clock pulses occurring while the engine is operated with the electromagnetic bypass air valve 13 closed is represented by $N_{r1}$.

Figure 9:
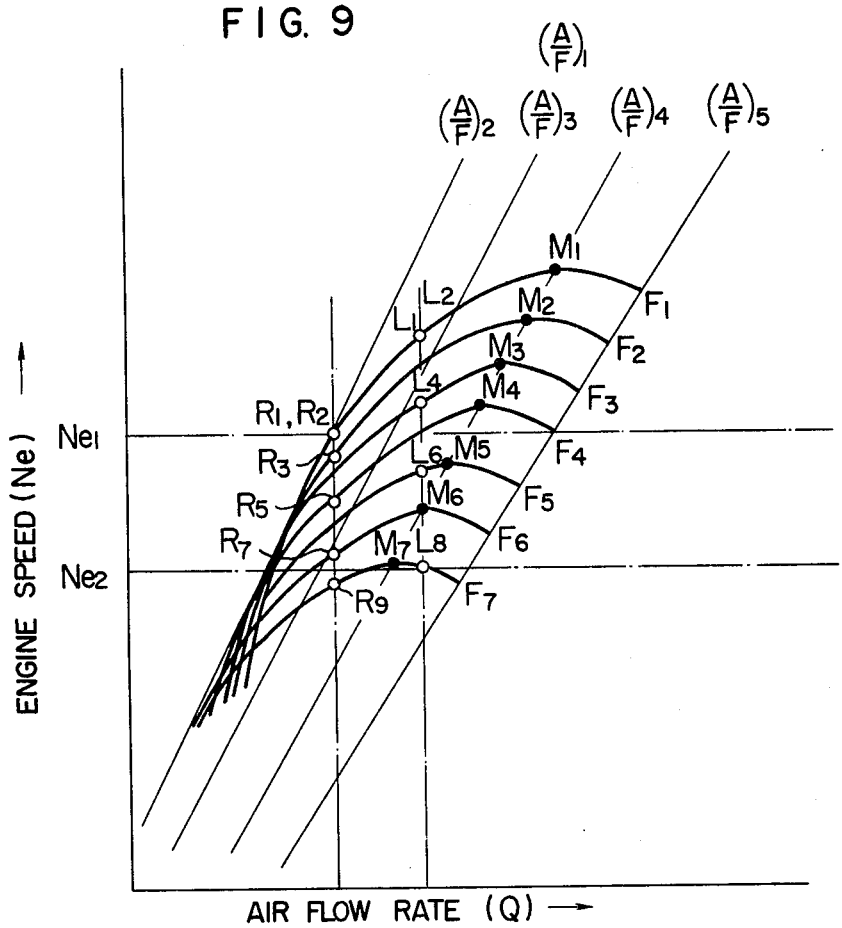
FIG. 9 is a characteristic diagram showing the relation of the engine speed versus the air flow rate.

Further, this processing operation will be described with reference to the characteristic diagram of FIG. 9 showing the relation between the air flow rate Q and the engine speed $N_e$ with the shaft torque of the engine maintained constant. Firstly, the abovementioned condition corresponds to the position of $R_1$ in FIG. 9. In FIG. 9, the curves $F_1, F_2, \ldots, F_7$ ($F_1 > F_2 > F_3 > \ldots > F_7$) represent the changes of the rotational speed of the engine as the air flow rate changes, with the fuel flow rate (the fuel supply quantity) F taken as a parameter. The straight lines (A/F), labelled as $(A/F)_1, (A/F)_2 \ldots, (A/F)_8$, respectively, indicate the relation between the change of the engine speed and the change of the air flow rate, with the air-fuel ratio A/F taken as a parameter. Generally, the value of the air-fuel ratio (A/F), which gives the highest engine speed with the quantity of the air-fuel mixture maintained constant, is about 13. The points M, labelled as $M_1, M_2, \ldots M_7$, indicative of the highest engine speeds, with the fuel flow rate taken as a parameter, occur on the line of the air-fuel ratio $(A/F)_4$. At these points M, the least fuel consumption for each fuel flow rate is attained. The present invention aims to effect automatic control toward these points M.

For example, assume that the engine is operating at a rotational speed $N_{el}$ and that the initial operating state is at a point $R_1$ on the line of the fuel flow rate $F_1$. It will be seen that the operating condition with the least fuel consumption can be attained when the engine is operated at the air-fuel ratio $(A/F)_4$ between the points $M_4$ and $M_5$, namely, between the fuel flow rates $F_4$ and $F_5$ for the same engine speed.

Referring again to the flowchart of FIG. 3, the process is advanced to next steps 115 and 116, where the comparison of four preceding rotational periods including the rotational period $N_r$ of the present rich step, i.e., $N_{l-1}$, $N_{r-1}$, $N_l$ and $N_r$ is effected. Here, $N_r$ is the rotational period of the present rich step, $N_l$ that of the last lean step, $N_{r-1}$ that of the last but one rich step, and $N_{l-1}$ that of the last but one lean step.

As a result of the above-mentioned comparison, the step 115 decides whether or not the relation $N_{l-1}>N_{r-1}<N_l>N_r$ holds. If this relation holds, the step 115 branches to YES, and the process transfers to a step 119. This indicates that, since the engine speed increases at the rich step and it decreases at the lean step, the increase of fuel supply increases the engine speed and improves fuel consumption.

At steps 117 and 119, the pulse duration correction value $\Delta T(p, r)$ is computed. The pulse duration correction value $\Delta T(p, r)$ corresponding to the present engine speed $N_e$ and intake pressure $P_m$ is read from a corresponding address of the map stored in the non-volatile memory region in the computing circuit. The increment $\Delta t$ is added to or subtracted from the pulse duration correction value $\Delta T(p, r)$ as required, and the computed value of $\Delta T(p, r)$ is written in the corresponding address of the map.

When the relation $N_{l-1}>N_{r-1}<N_l>N_r$ does not hold at the step 115, the process proceeds to a step 116. The condition of this step corresponds to the engine operation point in FIG. 9 where the engine is operated at a air-fuel ratio higher than that at the point M for the best fuel consumption, and the relation $N_{l-1}<N_{r-1}>N_l<N_r$ holds. Then, the step 116 branches to YES, and the process proceeds to a step 117, where the value $\Delta t$ is subtracted from the pulse duration correction value $\Delta T(p, r)$ from the map which corresponds to the present engine operating condition and the result is stored in the memory. In other words, the quantity of fuel injection is reduced by an amount of fuel supply corresponding to the pulse duration $\Delta t$ thereby to approach the optimum fuel supply quantity.

If both relations $N_{l-1}>N_{r-1}<N_l>N_r$ and $N_{l-1}<N_{r-1}>N_l<N_r$ do not hold, the process proceeds to a step 118 where no correction is made on the value $\Delta T(p, r)$. For instance, when the operating state of the engine changes in a transient condition of its operation, namely, when the engine is accelerated by depressing an accelerator pedal, as an example, the engine speed change caused by the operation of the accelerator pedal becomes far greater than that due to the change of an air-fuel ratio caused by a small change of the quantity of air supply at a rich or lean step, so that the engine speed rises steadily. As a result, the relation of the rotational periods becomes $N_{l-1}>N_{r-1}>N_l>N_r$, and therefore the conditions of decision at both steps 115 and 116 are not satisfied, so that the process proceeds to the step 118 where no correction of $\Delta T(p, r)$ is effected. Further, also when the present air-fuel ratio is at a value to give the least fuel consumption, the relation $N_{l-1}=N_{r-1}=N_l=N_r$ holds, and no correction is made to maintain the optimum fuel injection quantity.

Upon completion of the step 117, 118 or 119, the process proceeds to a step 120 where a decision is made as to whether a rich step (X=0) or a lean step (X=1) is presently the case. If a rich step (X=0) is the case, the step 120 branches to NO, and the process proceeds to a step 121. If a lean step (X=1) is the case, on the other hand, the step 120 branches to YES, and the process returns to the step 100. Then, after the completion of the steps 100 to 114 again, the step 120 branches to NO, and the process proceeds to the step 121. At the step 121, since a lean step is the case and hence X=1 holds, the electromagnetic bypass air valve 13 is opened. At steps 122 and 123, inputting and computation, which are similar to those at the steps 101 and 102, are effected. At a step 124, the count of the number of fuel injections Y is set to zero.

At steps 125 to 127, the computation similar to those at the steps 104 to 106 is effected. At a step 128, a decision is made as to whether the opening of the throttle valve 4 is 60% or more in a manner similar to the step 107. If the opening of the throttle valve 4 is 60% or more, the step 128 branches to YES, and the process transfers to a step 138. At the step 138, the electromagnetic bypass air valve 13 is closed. At the step 139, the pulse duration for the output air-fuel ratio is computed, and the control toward an air-fuel ratio for the least fuel consumption is stopped. At the step 140, a pulse duration signal is output to the fuel injector 15. Then, the process transfers to the step 103, and the control is restarted from the beginning.

If the step 128 branches to NO, the process proceeds to a step 129 where a decision is made as to whether the throttle valve 4 is totally closed. If the throttle valve 4 is totally closed, the step 129 branches to YES, and the process proceeds to a step 141. At the step 141, the electromagnetic bypass air valve 13 is closed like at the step 138. In the next step 142, the computation of the pulse duration for the idling air-fuel ratio is effected. In the step 143, the pulse duration signal thus obtained is output to the fuel injector 15. Then, the process proceeds to the step 103 where the control is restarted from the beginning.

If the throttle valve 4 is not totally closed, the step 129 branches to NO, and the process proceeds to a step 130. At steps 130 to 132, computations similar to those at the steps 109 to 111 are effected. At a step 133, a decision is made as to whether the count of the number of injections Y has reached the set number of injections K ($=2\times D_{op}$), and if the count Y has not yet reached the set number of injections K, the step 133 branches to NO, and the process circulates along a looped path formed by the steps 125 to 133.

At the step 133, when the count of the number of injections Y reaches the number K ($=2\times D_{op}$), the step branches to YES, and the process proceeds to a step 134 where X is set to 1 to store the fact that the present step is a lean one. At a step 135, the rotational period $N_l$ of the lean step is stored in the memory like at the step 114.

If a step 136 decides that the relation $N_{r-1}<N_{l-1}>N_r>N_l$ holds, the process transfers to the step 119 like at the step 115, at which step 119 $\Delta t$ is added to the pulse duration correction value $\Delta T$ (p, r) and the result is stored in the memory. If the relation $N_{r-1}<N_{l-1}>N_r<N_l$ does not hold at the step 136, on the other hand, the step 136 branches to NO, and the process proceeds to a step 137 where a decision is made as to whether the relation $N_{r-1}>N_{l-1}<N_r>N_l$ holds. If this relation holds, the step 137 branches to YES, and the process proceeds to the step 117 where $\Delta t$ is subtracted from the pulse duration correction value $\Delta T(p, r)$ and the result is stored in the memory. On the other hand, if this relation does not hold, the step 137 branches to NO, and the process proceeds to the step 118 where no correction is made on the pulse duration correction value $\Delta T(p, r)$.

Upon completion of the step 117, 118 or 119, the process advances to the step 120 where a decision is made as to whether the present step is a lean one or not. Since the process has proceeded through the steps 121 to 135 to effect the processing for a lean step (X=1) till then, the step 120 now branches to YES, and the process transfers to the step 100.

By the method of control as mentioned above, if there is any deviation from the air-fuel ratio corresponding to the least fuel consumption under a normal engine operation, correction can be effected to control the air-fuel ratio at a value which gives the least fuel consumption. Further, since optimum correction values $\Delta T(p, r)$ for each engine operating condition is stored in the memory of the computing circuit 14, each operating condition of the engine may always be controlled to be in an optimum state.

Now, the relation between the above-mentioned operation processes and the practical driving of an automobile will be explained below with reference to the characteristic diagram of FIG. 9. In this diagram, the curves $F_1$ to $F_7$ denote the relation between the air flow rate and the engine speed when the fuel flow rate is fixed at the values of $F_1$ to $F_2$ as a parameter, respectively. The first rich step is positioned at a point $R_1$, the first lean step at a point $L_1$, the point, which gives the least fuel consumption for the fuel flow rate $F_1$, at a point $M_1$, the second rich step at a point $R_2$, and the second lean step at a point $L_2$. After the control is effected up to the second lean step $L_2$, the relation $N_{R1}>N_{L1}<N_{R2}>N_{L2}$ can be deduced from the decision to be made on the relation $N_{r-1}>Nl-1<N_r>N_l$ at the step 137 of FIG. 3. Then, the pulse duration is reduced by $\Delta t$ at the step 117, with the result that the fuel flow rate is shifted from the curve $F_1$ to the curve $F_2$ ($F_1>F_2$), and the operation of the engine is performed at a point $R_3$. After completion of the engine operation at the point $R_3$, the relation $N_{L1}<N_{R2}>N_{L2}<N_{R3}$ is obtained similarly at the step 116, and the following step 117 reduce the pulse duration by $\Delta t$, thereby shifting the fuel flow rate from the curve $F_2$ to the curve $F_3$ ($F_2>F_3$). Thereafter, similar corrections are effected successively. Then, when the engine operation point reaches a point $L_8$ on the curve $F_7$, the relation $N_{R5}>N_{L6}<N_{R7}<N_{L8}$ holds disatisfying the relation set at the step 137, so that the step 137 branches to NO, and the process transfers to the step 118. Thus, the fuel flow rate is not corrected to become lower than $F_7$.

In this way, the engine is operated at a point close to the point $M_7$ on the curve $F_7$ of the constant fuel flow rate $F_7$ which corresponds to the least fuel consumption. However, if the engine speed, which the driver desired initially, is $N_{e1}$, the driver will continue to depress the accelerator pedal until the engine speed of $N_{e1}$ is reached, when he takes notice of the drop in the engine speed from $N_{e1}$ to $N_{e2}$. As a result, the engine operation is shifted to a point on a fuel flow rate curve between the curves $F_4$ and $F_5$, which point is close to a point indicative of the least fuel consumption on the fuel flow rate curve.

In the first embodiment, a dither period is obtained by the equation of multiplication $D_{op}=K_1\times N_e\times V_p$. As an alternative, it may be possible to read the value of the dither period $D_{op}$ from a map stored in the memory in which map the values of the dither periods $D_{op}$ are arranged to correspond to the present engine speed $N_e$ and the intake pressure $P_m$ detected by the pressure sensor 9.

Figure 10:
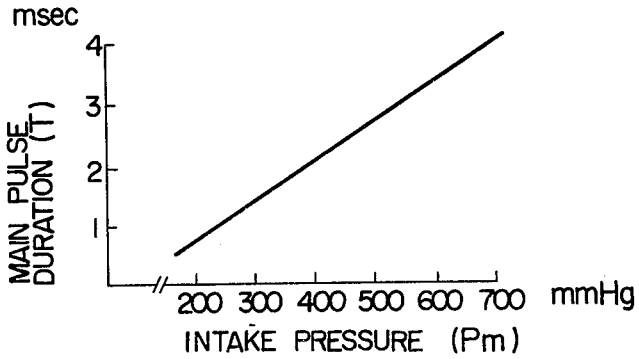
FIG. 10 is a characteristic diagram showing the relation of the main pulse duration versus the intake pressure.

Further, since there is a correspondence between the main pulse duration $T_m$ and the intake pressure as shown in FIG. 10, the value of the dither period may be given by the equation $D_{op}=K_2\times N_e\times T_m$ ($K_2$: a constant), where the main pulse duration $T_m$ is used in place of the intake pressure $P_m$ or the corresponding detection signal voltage $V_p$.

Although the dither period is determined in terms of the engine speed in the first embodiment, alternatively it may of course be determined in terms of time.

Figure 11:
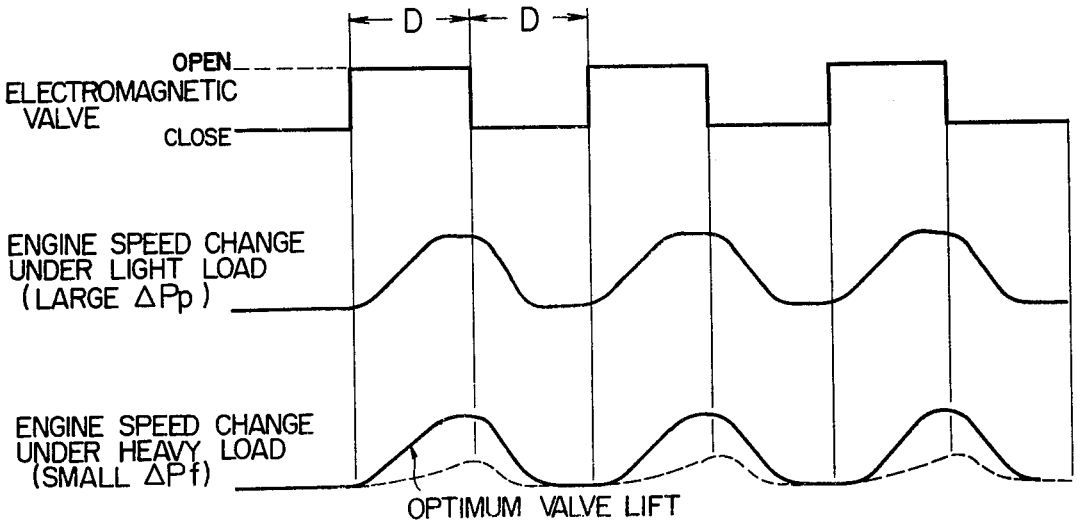
FIG. 11 is a waveform diagram showing the relation of the change of the engine speed with respect to the lift of the electromagnetic valve at a constant dither period for each operating condition of the engine.
Figure 12:
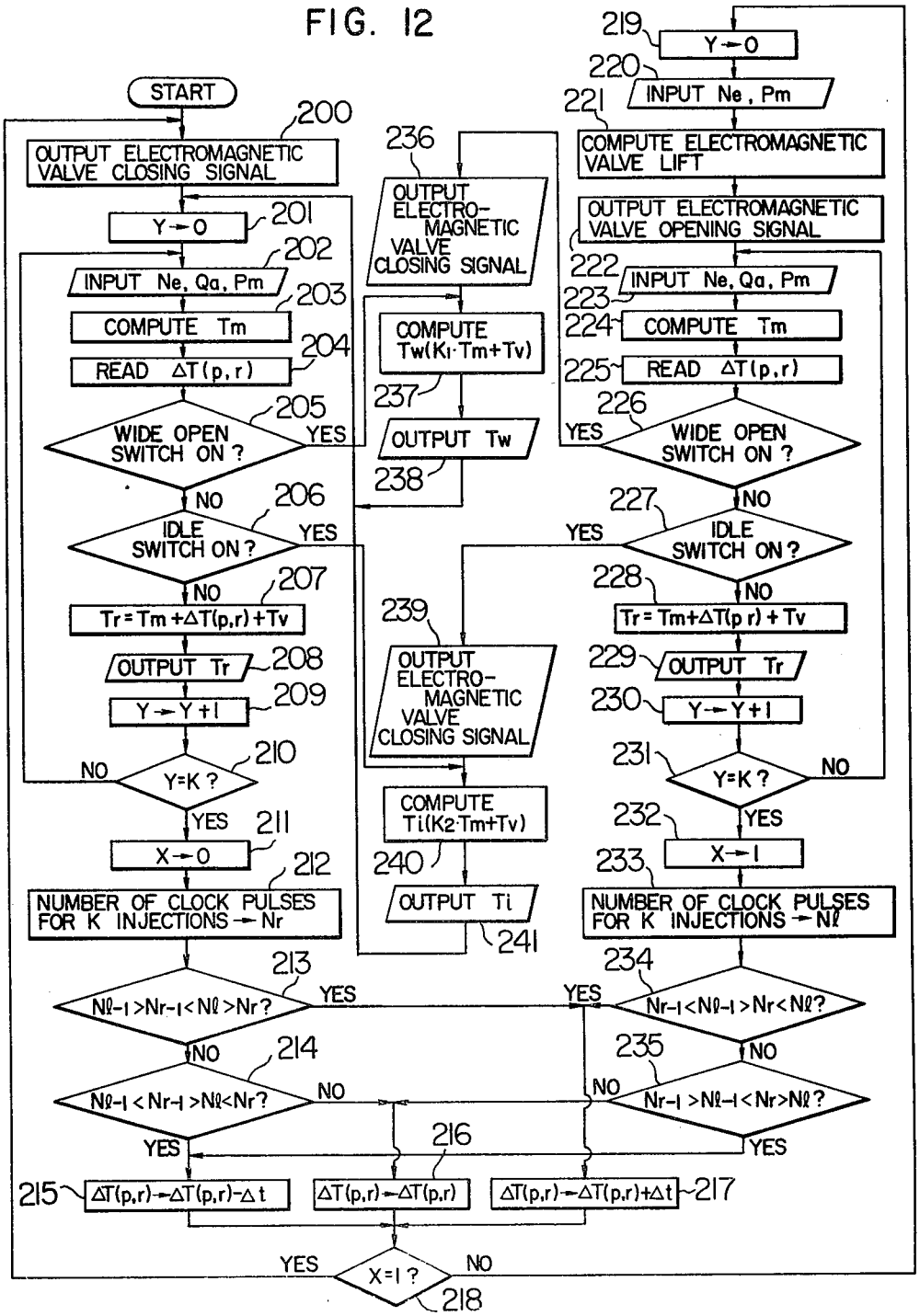
FIG. 12 is a flowchart showing the operation processes of a computing circuit according to another embodiment of the present invention.

Further, in the first embodiment described above, the control of the bypass air quantity is effected only by changing the dither period by the use of an on-off electromagnetic valve having a fixed degree of opening. However, in another embodiment of this invention, it is possible to use an electromagnetic valve of the variable opening type whose valve lift is controlled by an engergization current, while the dither period is maintained constant for all engine operating conditions. In this case, the bypass air quantity may be controlled by changing the valve lift (the dither quantity) according to a value obtained by the computation for each dither period or a map stored in the memory, which makes it possible to make a decision with similarly elevated precision. FIG. 11 shows the change of the engine speed when the throttle opening area of the electromagnetic valve is changed under a heavy load in the other embodiment. In FIG. 11, the dotted line shows the change of the engine speed with the throttle opening area maintained constant. FIG. 12 shows a flowchart for controlling the valve lift (the dither quantity) with the dither period fixed in the other embodiment.

Further, it is possible to construct the apparatus of this invention such that both the dither period and the valve lift (the dither quantity) are computed at the same time for each engine operating condition or read from the map stored in the memory.

Figure 13:
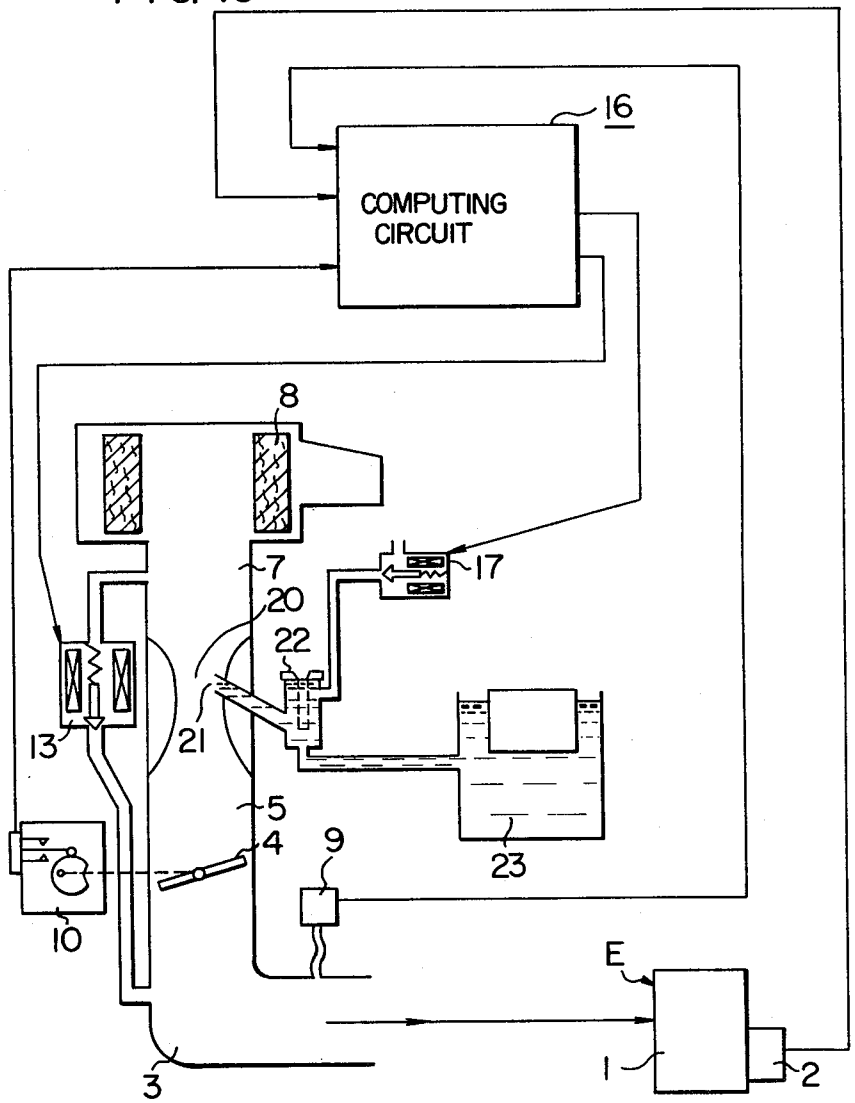
FIG. 13 is a schematic diagram showing an apparatus for controlling an air-fuel ratio of an internal combustion engine used in the method of controlling the air-fuel ratio of the engine according to another embodiment of the present invention.

FIG. 13 shows another example of the air-fuel control apparatus for internal combustion engines which is a separate embodiment of this invention different from the embodiment shown in FIG. 1. In the apparatus of FIG. 13, fuel is supplied from a main nozzle 21 disposed at a venturi portion 20 of the carburetor, and there is provided an electromagnetic valve 17 for introducing air into an air bleed chamber 22 arranged midway of a fuel pipe leading from a float chamber 23 to the main nozzle 21. The electromagnetic bypass air valve 13 supplies air bypassing the carburetor. The electromagnetic bypass air valve 13 is operated on the basis of the computation made at a computing circuit 16 comprising a microcomputer for handling digital signals. The computing circuit 16 executes operation processing in a manner similar to the process illustrated in FIG. 3. Thus, the correction of the fuel supply quantity is effected by changing a duty factor of an energization signal of a constant frequency supplied to the electromagnetic valve 17 thereby to control the air bleed quantity.

In the apparatus of FIG. 1, a single electromagnetic bypass air valve 13 is used to provide two levels of a rich step and a lean step by the on-off operation of the electromagnetic bypass air valve 13. Alternatively, two electromagnetic bypass air valves may be used to provide three levels of air-fuel ratio, namely, no bypass (a rich step R), one electromagnetic bypass air valve actuated (a basic step B) and two electromagnetic bypass air valves actuated (a lean step L), and the engine is operated in the step order of $B_1 \rightarrow R_2 \rightarrow B_3 \rightarrow L_4 \rightarrow B_5 \rightarrow R_6 \rightarrow B_7 \rightarrow \ldots$. After the completion of the engine operation through five of the steps, comparison is made among the five rotational periods corresponding to the five steps. When the two relations $N_{B1}, N_{B3} > N_{R2}$ and $N_{B3}, N_{B5} < N_{L4}$ hold, $\Delta t$ is added to the pulse duration correction value $\Delta T$ (p, r), and when the two relations $N_{B1}, N_{B3} < N_{R2}$ and $N_{B3}, N_{B5} > N_{L4}$ hold, $\Delta t$ is subtracted from the pulse duration correction value $\Delta T$(p, r).

It will be understood from the foregoing descriptions that, in the method and apparatus for optimum control of internal combustion engines according to the present invention, either the length of the period during which an internal combustion engine is operated at two or more different fixed levels of air-fuel ratios or the levels, at which the air-fuel ratio is changed, is determined by a signal associated with the operating state of the internal combustion engine, whereby the decision of the direction of the change of the air-fuel ratio for improving fuel consumption can be made with elevated precision so that it is made possible to effect feedback control seeking an air-fuel ratio for attaining least fuel consumption.

We claim:

1. In a method for optimum control of an internal combustion engine comprising the steps of changing an air-fuel ratio alternately to richer and leaner directions with respect to a basic air-fuel ratio by a dither quantity during a dither period, operating said engine by supplying said engine with a mixture of the changed air-fuel ratio, detecting a resultant change in an output of said engine, deciding the direction of a change of the air-fuel ratio toward an optimum air-fuel ratio on the basis of the result of said detection, and modifying the basic air-fuel ratio in the direction of said change toward an optimum air-fuel ratio on the basis of the result of said decision, thereby optimizing fuel consumption of said engine;

wherein said optimum control method further comprises the steps of detecting an operating state of said engine and producing signals associated with the operating state of said engine including a rotational speed of said engine which is used to detect the change in the output of said engine in accordance with a change therein, and changing at least one of said dither period and dither quantity in accordance with said signals, and wherein the changing of the air-fuel ratio is effected by dithering an air supply quantity to said engine, and the modifying of the basic air-fuel ratio is effected by modifying a basic fuel supply quantity to said engine in the direction of improving the output of said engine, and wherein the direction of the change in the output of said engine is decided in accordance with the relation between the engine rotational speeds detected at the dithering of the air supply quantity to said engine on a first basic fuel supply quantity to said engine and those detected at the dithering of the air supply quantity to said engine on a second basic fuel supply quantity to said engine.

2. A method for optimum control of an internal combustion engine comprising the steps of changing an air-fuel ratio alternately to richer and leaner directions with respect to a basic air-fuel ratio by a dither quantity during a dither period, operating said engine by supplying said engine with a mixture of the changed air-fuel ratio, detecting a resultant change in an output of said engine, deciding the direction of a change of the air-fuel ratio toward an optimum air-fuel ratio on the basis of the result of said detection, and modifying the basic air-fuel ratio in the direction of said change toward an optimum air-fuel ratio on the basis of the result of said decision, thereby optimizing fuel consumption of said engine;

wherein said optimum control method further comprises the steps of detecting an operating state of said engine and producing signals associated with the operating state of said engine, and changing at least one of said dither period and dither quantity in accordance with said signals, and wherein the changing of the air-fuel ratio is effected by dithering an air supply quantity to said engine, and the modifying of the basic air-fuel ratio is effected by modifying a basic fuel supply quantity to said engine in the direction of improving the output of said engine in accordance with said signals.

3. A method according to claim 2, wherein said signals associated with the operating state of said engine represent the engine speed and the intake pressure.

4. A method according to claim 2, wherein said signals associated with the operating state of said engine include a signal representative of the engine speed and the dither period is increased as the engine speed increases.

5. A method for optimum control of an internal combustion engine according to claim 2, wherein said engine comprises electromagnetic fuel injectors and said signals associated with the operating state of said engine represent the engine speed and the main pulse duration for actuating said electromagnetic fuel injectors.

6. A method according to claim 2 or 5, comprising the step of modifying a fuel supply quantity to modify the basic air-fuel ratio.

7. An apparatus for optimum control of an internal combustion engine comprising an intake pipe, a throttle valve disposed in said intake pipe, a bypass air control device connected to said intake pipe in a manner to bypass said throttle valve, a fuel supply device, an engine speed sensor, an intake pressure sensor and an operating unit, input terminals to said operating unit being connected to respective output terminals of said engine speed sensor and intake pressure sensor, output terminals of said operating unit being connected to respective input terminals of said bypass air control device and said fuel supply device, said operating unit computing at least one of a dither period and a dither quantity of a dither signal for dithering an air-fuel ratio of a mixture gas supplied to said engine on the basis of the input signals thereto and outputting said dither signal, energizing said bypass air control device by said dither signal to effect dithering of an air supply quantity to said engine, thereby effecting dithering of the air-fuel ratio above and below a basic air-fuel ratio, deciding a direction of a change of the air-fuel ratio for improving an output of said engine on the basis of the input signal from said engine speed sensor, and optimizing fuel consumption of said engine by modifying a basic fuel supply quantity to said engine in the direction of improving the output of said engine.

8. An apparatus according to claim 5, wherein said bypass air control device includes an on-off electromagnetic valve whose opening degree is controlled by an output signal of said operating unit.

9. An apparatus according to claim 7, further comprising an intake air flow sensor disposed midway of said intake pipe, an output terminal of said intake air flow sensor being connected to one of the input terminals to said operating unit.

10. An apparatus according to claim 9, wherein said operating unit further comprises a memory and has a construction for computing the dither period, producing a control signal for controlling said bypass air control device, computing a basic fuel supply quantity for determining the basic air-fuel ratio and modifying a selected one of fuel supply quantity correction values stored in said momery, on the basis of input signals from said engine speed sensor, said intake pressure sensor and said intake air flow sensor, respectively, and producing a control signal for controlling said fuel supply device.

11. An apparatus according to claim 10, wherein said fuel supply quantity correction values are stored in said memory in the form of a two-dimensional map in accordance with the values of the engine speed and intake pressure, respectively.

* * * * *